US008965605B2

(12) United States Patent
Sengupta et al.

(10) Patent No.: US 8,965,605 B2
(45) Date of Patent: Feb. 24, 2015

(54) SYSTEM AND METHOD FOR VEHICLE MOVEMENT MODELING IN A RAILWAY NETWORK

(71) Applicant: Tata Consultancy Services Limited, Mumbai (IN)

(72) Inventors: Siddhartha Sengupta, Mumbai (IN); Sunil D Joshi, Mumbai (IN)

(73) Assignee: Tata Consultancy Services Limited, Mumbai (IN)

( * ) Notice: Subject to any disclaimer, the term of this patent is extended or adjusted under 35 U.S.C. 154(b) by 0 days.

(21) Appl. No.: 13/903,060

(22) Filed: May 28, 2013

(65) Prior Publication Data

US 2013/0325223 A1 Dec. 5, 2013

(30) Foreign Application Priority Data

May 29, 2012 (IN) ..... 1597/MUM/2012

(51) Int. Cl.

| | |
|---|---|
| ***G05D 1/00*** | (2006.01) |
| ***B61C 17/12*** | (2006.01) |
| ***B61L 3/00*** | (2006.01) |
| ***B61L 27/00*** | (2006.01) |

(52) U.S. Cl.

CPC ..... *B61C 17/12* (2013.01); *B61L 3/006* (2013.01); *B61L 27/0027* (2013.01); *B61L 27/0016* (2013.01); *B61L 27/0022* (2013.01)

USPC ..... 701/19

(58) Field of Classification Search

USPC ..... 701/19

See application file for complete search history.

(56) References Cited

U.S. PATENT DOCUMENTS

| | | | | |
|---|---|---|---|---|
| 5,340,062 | A | 8/1994 | Heggestad | |
| 5,794,172 | A | 8/1998 | Matheson et al. | |
| 5,978,717 | A | 11/1999 | Ebersohn et al. | |
| 2007/0219680 | A1 | 9/2007 | Kumar et al. | |
| 2009/0125170 | A1 * | 5/2009 | Noffsinger et al. | 701/20 |
| 2009/0143927 | A1 * | 6/2009 | Julich et al. | 701/19 |

OTHER PUBLICATIONS

Afonso, Pedro Alexandre de carvalho, "Railway Traffic Management" Dissertation submitted for obtaining the degree of Master in Electrical and Computer Engineering Sep. 2008.

Park, B.H. et al., "The mathematical approach for train conflict detection and resolution: In case autonomous decentralized traffic control for heavy traffic station" Korea Railroad Research Institute, Uiwang-City, Korea and Korea National Railroad College, Uiwang-City, Korea2.

* cited by examiner

*Primary Examiner* — James Trammell
*Assistant Examiner* — Michael D Lang
(74) *Attorney, Agent, or Firm* — Finnegan, Henderson, Farabow, Garrett & Dunner LLP

(57) ABSTRACT

The present disclosure relates to a system and a method for vehicle movement modeling in a network. The modeling may be characterized by vehicle related intelligence gathering, processing and dissemination thereof for an adaptive rescheduling of the vehicle movement in the railway network. Predefined data associated with the vehicle in the railway network is acquired and is further processed to resolve one or more conflicts associated with the vehicle movement. The processing may include allocating resources, developing plans for voyages, and continuously gathering deviation data. The vehicle movement modeling may also include generating detailed layouts of vehicle movements for particular time-periods over the railway network.

25 Claims, 4 Drawing Sheets

SYSTEM AND METHOD FOR VEHICLE MOVEMENT MODELING IN A RAILWAY NETWORK

CROSS-REFERENCE TO RELATED PATENT APPLICATION

The present application claims priority under 35 U.S.C. §119 to Indian Patent Application No. 1597/MUM/2012, filed May 29, 2012. The aforementioned application is incorporated herein by reference in its entirety.

TECHNICAL FIELD

The present disclosure in general relates to a method and system for vehicle movement modeling in a transportation network. More particularly, the disclosure relates to a method and system for adaptive rescheduling of vehicle movement in a railway network.

BACKGROUND

A Railway network is a vast and complex system which is further divided into various small sub-systems. Although some automation is there to control train operations and plan their schedule, however, a large man power is also engaged to manage the planning and operation of railway networks.

Hitherto, at many of the control stations, controllers use train graphs to manually predict train arrival and departure times. But since a long time, it has been a challenge for railway management authorities to overcome constant operational disruptions, big and small. Such disruptions are handled manually. This manual task is very time consuming, error prone and, above all, sub optimal.

In order to address the above summarized problems, many solutions have been proposed. Hitherto, though many systems and solutions are disclosed, they seldom may address issues related to train operations considering ground realities and external condition associated therewith.

The system and solutions disclosed in the prior arts are more often of academic nature and are inclined to take into account only some operating issues. Such models attempt to automate conflict resolution in railway plans. While the solutions and systems disclosed hitherto may provide insights for a functional automation of plurality of tasks, they do not cover the ground realities of arcane railway operating practices, policies and myriad operating details. Therefore, to resolve such a critical transportation problem associated in dealing with optimal & reactive planning of transportation operations, a flexible system that operates to make each node in the operation an intelligent node is required. Such intelligence delivered to each operational node is further required to be optimal, rapidly responsive, realistic, and user friendly.

SUMMARY

The present disclosure discloses a method for a vehicle movement modeling in a railway network, characterized by vehicle related intelligence gathering, processing and dissemination thereof for an adaptive rescheduling of the vehicle movement in the railway network. The method may include acquiring, predefined data for type, position, movement and schedule associated with vehicles in railway networks with respect to changes at regular intervals and processing the acquired data to ensure the absence of resource usage conflicts in the railway network. The processing may further include allocating one or more resources for one or more complete voyages of one or more vehicles and developing plans for the voyages that minimize deviations of scheduled vehicles from published timetables or maximize a throughput of non-timetabled vehicles. The method may further include generating one or more train graphs and detailed layouts of past, present and future vehicular movements on a plurality of sections of the railway networks, over a defined time horizon.

The present disclosure also discloses a system for vehicle movement modeling in a railway network, characterized by vehicle related intelligence gathering, processing and dissemination thereof for an adaptive rescheduling of the vehicle movements in the railway network. The system may include a first processor configured to acquire, a predefined data for type, position, movement and schedule associated with the vehicle in the rail network with respect to changes at regular intervals and a second processor configured to process the acquired data to generate conflict-free vehicle movement plans in a railway network. The second processor may further include a planning module configured to allocate one or more resources for one or more complete voyages of one or more vehicles and a computation means configured to minimize deviations of scheduled vehicles from published timetables or maximize a throughput of non-timetabled vehicles ensuring an absence of conflicts in the use of resources during the voyages. The system may further include a third processor configured to generate visual depictions of the plans in the form of train graphs and detailed layouts of vehicle movement of past, present and future vehicular movements on a plurality of sections of the railway networks over a defined time horizon.

Figure 1A:
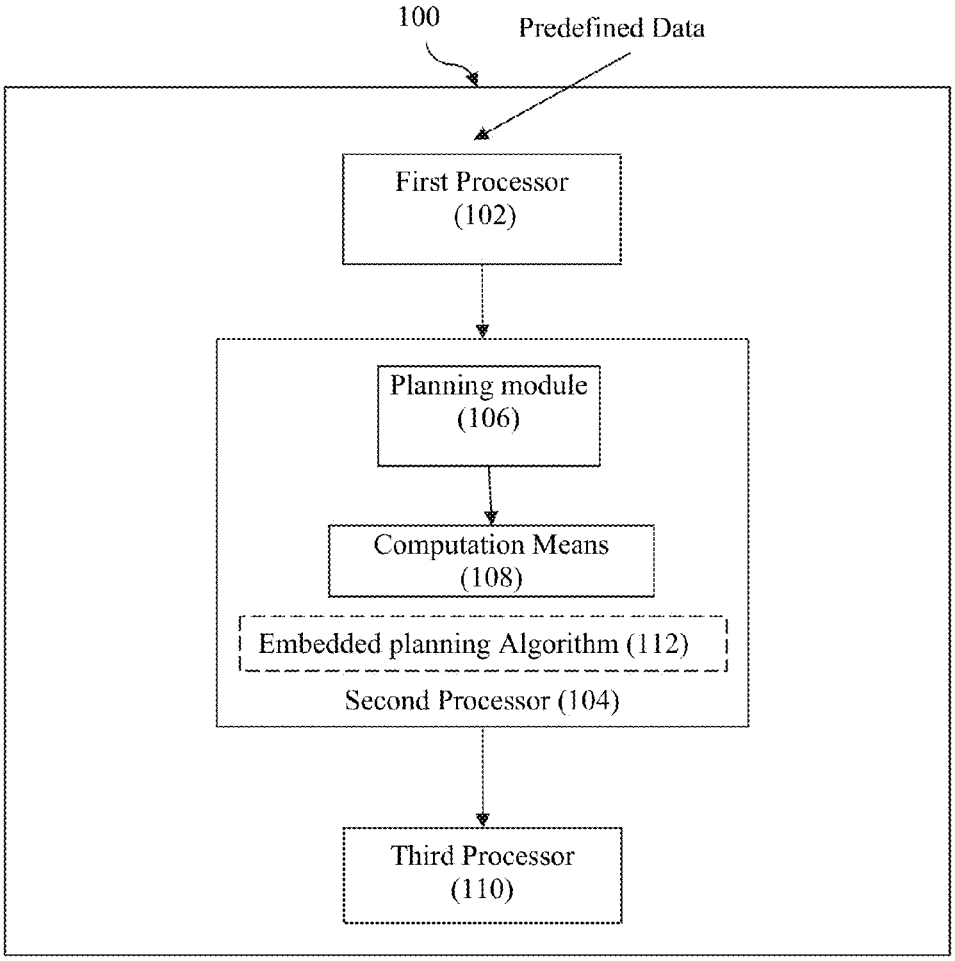
FIG. 1*a* illustrates the system architecture in accordance with an embodiment of the disclosure.

The nature and configurations of the hardware and communications components and user roles as depicted are merely indicative.

DETAILED DESCRIPTION

Some embodiments of this disclosure, illustrating its features, will now be discussed. The words "comprising", "having", "containing", and "including", and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a", "an", and "the" include plural references unless the context clearly dictates otherwise. Although any systems, methods, apparatuses, and devices similar or equivalent to those described herein can be used in the practice or testing of embodiments of the present disclosure, the preferred, systems and parts are now described. In the following description for the purpose of explanation and understanding reference has been made to numerous embodiments for which the intent is not to limit the scope of the disclosure.

One or more components of the disclosure are described as module for the understanding of the specification. For example, a module may include self-contained component in a hardware circuit comprising of logical gate, semiconductor device, integrated circuits or any other discrete component. The module may also be a part of any software program executed by any hardware entity for example processor. The implementation of module as a software program may include a set of logical instructions to be executed by the processor or any other hardware entity. Further a module may be incorporated with the set of instructions or a program by means of an interface.

The disclosed embodiments are merely exemplary of the disclosure, which may be embodied in various forms.

The present disclosure relates to a system and a method for vehicle movement modeling in a network. The modeling is characterized by vehicle related intelligence gathering, processing and dissemination thereof for rapid adaptive rescheduling of vehicle movements in railway networks. Predefined data associated with the vehicle in the railway network may be acquired with respect to one or more changes thereto or at regular intervals and may be further processed to create conflict-free reactive reschedules of the future vehicular movements. The processing may include allocating resources, developing plans for voyages. The vehicle movement modeling may also include generating one or more train graphs and detailed layouts of past, present and future vehicular movements on a plurality of sections of the railway networks, over a defined time horizon.

In accordance with an embodiment, referring to FIG. 11*a*, a system (100) for a vehicle movement modeling in a railway network may include a first processor (102) for acquiring data associated with the vehicle. The second processor (104) may generate conflict-free vehicle movement plans and further include a planning module (106) and a computation means (108). The system (100) may further include a third processor (110) which is configured to generate train graphs and detailed layouts of vehicle movement for particular time-periods over the railway network.

In accordance with an embodiment, still referring to FIG. 1*a*, the vehicle movement modeling may be characterized by vehicle related intelligence gathering, thereof for a rapid adaptive rescheduling of the vehicle movements in railway networks. The vehicle may include without limitation a train.

The first processor (102) may be configured to acquire whenever there are changes thereto or at regular intervals predefined data for type, position, movement and schedule associated with vehicles in railway networks. The predefined data may include but is not limited to data related to trains, their type, position, movement and schedules, details of stations, geometry of tracks, etc. Some of this data can optionally be acquired through plurality of sensors (not shown in figure) which are distributed and embedded throughout the railway network.

In accordance with an embodiment, the second processor (104) may communicate with the first processor (102). The second processor (104) may include planning module (106) which is configured to optimally and rapidly allocate one or more resources for one or more complete voyages of one or more vehicles.

The computation means (108) may be configured to minimize deviations of scheduled vehicles from published timetables or maximize the throughput of non-timetabled vehicles ensuring the absence of conflicts in the use of resources during the voyages. One or more conflicts may include but is not limited to meeting and crossing of vehicles of equal or unequal priorities. The second processor (104) may further determine computation of one or more types of occupations which may include consideration of inter-vehicle safety gaps over and above the headway/section clearance by previous vehicle and inter-vehicle start gap to accommodate power consumption surges when electrically powered vehicles accelerate.

The planning module (106) may be further configured to allocate one or more resources for one or more complete voyages of one or more vehicles. Resource allocation may be one of the requirements for the reactive planning algorithm (112). One or more types of such resources may be unary resources or discrete resources. Unary resources may include but are not limited to the block sections and loops and the discrete resources may include but are not limited to electric traction power resources. Block sections may include tracks between stations and loops may include tracks within stations. Block section and loop occupancy planning may further include arranging vehicles in groups according to their priorities and allocating resources to them in a manner that is optimal, fast and conflict free.

Block section and loop resource allocation may be performed as computational Loop1, Loop2 and Loop3 below until all the movements of all vehicles have been forecast from their current positions or origins to destinations.

Loop1: Arrange all vehicles in groups according to their priorities. For each group of vehicles, in the decreasing order of priority, perform loop2.

Loop2: Arrange all vehicles in the group according to their start times. For each vehicle in the group, in the increasing order of their start times perform Loop3.

Loop3: For each vehicle allocate resources for future movements from current position or origin to destination in accordance to their type, position and schedule, and in a manner that is optimal, rapid and conflict free.

Different methods may be selected from a choice to automatically develop these conflict free plans and schedules for vehicle movements on the railway tracks. These methods may differ in the density of traffic that they can cater to produce reactive plans of different degrees of efficiency at the same rate at which events like vehicle arrivals and departures occur in the railway system. In one embodiment, among the several options, that can cater to very high traffic densities the system may use a heuristic based N-step algorithm with backtracking The vehicle may be assigned time to leave the current station, time to arrive and depart from the next $0 \leq n \leq N$ stations. Lower priority vehicles may be backtracked and assigned to their previous loop resources that are available for use.

Figure 1B:
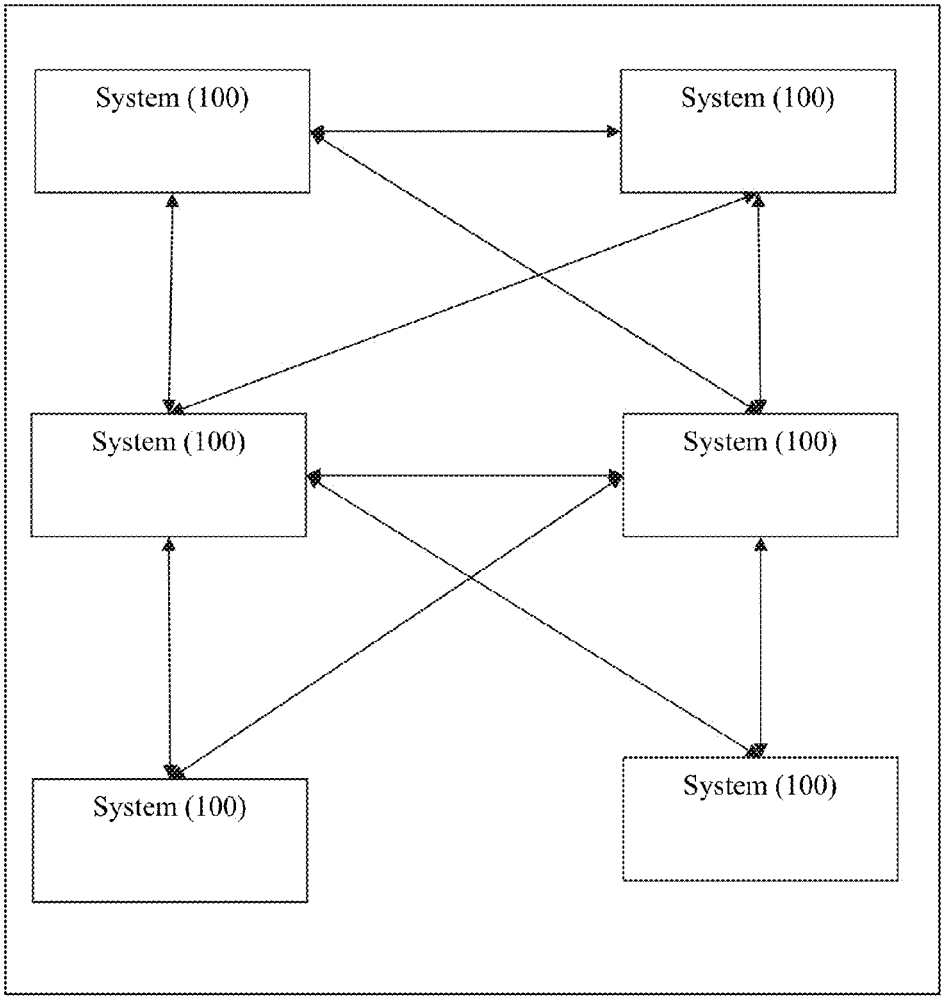
FIG. 1*b* illustrates an ensemble of internal networking, communicating and cooperating systems.

Referring to FIG. 1(*a*), the second processor (104) may provide an embedded forecast reactive planning algorithm (112) which enables scheduling of vehicle arrivals and departures in order to generate plans for optimal and conflict free vehicle movements.

The forecast reactive planning algorithm (112) may implement N-step look ahead with backtracking where one step includes two consecutive unary resources viz. a block section between departing station and the next, in the direction from its origin to its destination, and a loop line (siding, stabling line where a train can be parked for the halt time necessary), accessible from the block section, at the next station.

N is an integer number 1 or more which is pre-defined. N=1 may be a case where vehicles are advanced station by station whereas with a very large value of N (more than the number of stations on the route of a vehicle) vehicles may be advanced from their origins/current positions to their destinations in one iteration.

A block section may be a section between two stations such that train reordering (Crossing and/or precedence) can be arranged at either of the two.

Backtracking implements releasing resources allocated to a vehicle and moving it back to the previous step(s) and allocating the resources for the previous step(s).

The forecast reactive planning (112) algorithm may implement the following features for each vehicle selected for planning by ordering them on the basis of their priorities and departure times at their origins. The following describes the features for the special case of N=1. Readers skilled in the art will be able to extrapolate it for N>1.

Initialization: Prior to executing the resource blocking, the availability of the loop line at the departing station until the possible departure is ensured.

Will check that the selected vehicle has the resources for a step available through which and where it can be moved in the direction from its origin to its destination.

The availability of the resources may be checked with respect to the departure time at the departing station, intersection run time for the block section and arrival, halt and departure time at the arriving station and inter-train safety margins for section clearance.

For Absolute Block Signaling

In one embodiment, in case of absolute block signaling, resources for a step may be deemed available when the same are not used by any other vehicle for the time the vehicle in consideration is expected to occupy.

For Automatic Block Signaling

In another embodiment, in case of automatic block signaling, resources for a step may be deemed available when lead time of headway or more is maintained between departures of the vehicle in consideration and leading or following vehicle from the departing station and arrival times at the arriving station.

Having verified availability of the unary resources like block section and loop line, the availability of sufficient discrete resources like electric traction power, as applicable, may be verified. This may ensure power requirement for start and acceleration at the time of departure.

If the resources are available, they may be reserved for the vehicle.

If not available,

If the contention is with an equal or higher priority vehicle, the vehicle under consideration may not be progressed.

If the contention is with a lower priority vehicle, the resources reserved for the lower priority vehicle may be made available and the lower priority vehicle may be backtracked one step but not beyond its origin or the current position, as applicable. In case the lower priority vehicle cannot be backtracked, as in the previous paragraph, the vehicle under consideration may not be progressed.

The departure time of the vehicle may be set to the earliest possible time when the next block in its direction of movement becomes available as also when sufficient discrete resources (e.g. electric traction power) for the departing train to accelerate at its predefined power consumption rate are available.

Will allocate resources according to the requirements if possible. For example, passenger platforms for halting passenger carrying trains, main line for non-halting trains etc.

The computation means (108) may be configured to minimize deviations of scheduled vehicles from published timetables or maximize the throughput of non-timetabled vehicles ensuring the absence of conflicts in the use of resources during the voyages. The plan for the voyages may include but is not limited to:

plans for the voyages that schedule conflict-free meeting of vehicles over their interrelated voyages, plans for the voyages that are superior to common sense and manually-generated plans, plans for the voyages that are computed at least as rapidly as the occurrence of events within the railway network.

This plan generator or scheduling algorithm may ensure:

a. Track resources, as defined by signaling territories, are treated a unary resources where one task (track occupancy by a vehicle) may consume the entire resource over the task duration, obviating the possibility of conflicting multiple track occupation.

b. Electric traction power resources, as defined by power territories that are different from signaling territories, may be treated as discrete resources where the sum of the consumption by multiple tasks (consumption of traction power by multiple electrified vehicles) is limited to a value given by the power substation capacity. The consumption by a vehicle is given by its type.

Still referring to FIG. 1(*a*), the system (100) may further include a third processor (110) which may be configured to generate one or more relational train graphs and detailed layouts of past, present and future vehicular movements on a plurality of sections of the railway networks, over a defined time horizon.

The system (100) may further store historical information about data objects in proper time in order to enable the optional processing of the same in an offline mode. The offline mode usage of the system (100) may assist in developing time tables, routes, and infrastructure maintenance blocks, evaluate option for infrastructure investments including tracks, signaling and operating practices.

The system (100) may implement a method of inferring the track and power territory resource occupations both for generating the movement plans and the display graphics, from a common set of description files input to the first module.

Moreover, the system may include an ensemble of a multiplicity of internal networking, communicating and cooperating systems (100) to cover a multiplicity of networked railway sections.

In accordance with an embodiment, the one or modules as described for the system (100) may also communicate remotely with each other.

Moreover, the processing module (first, second and the third processor) and the communications systems can be used in multiple signaling and traction power systems.

In addition, referring to FIG. 1(*b*), there may exist plurality of system (100) in a plurality of railway networks. All such system (100) may communicate with each other.

The system and method for vehicle movement modeling for an adaptive rescheduling of the vehicle movements in the railway network may be illustrated by working example stated in the following paragraphs.

Figure 2:
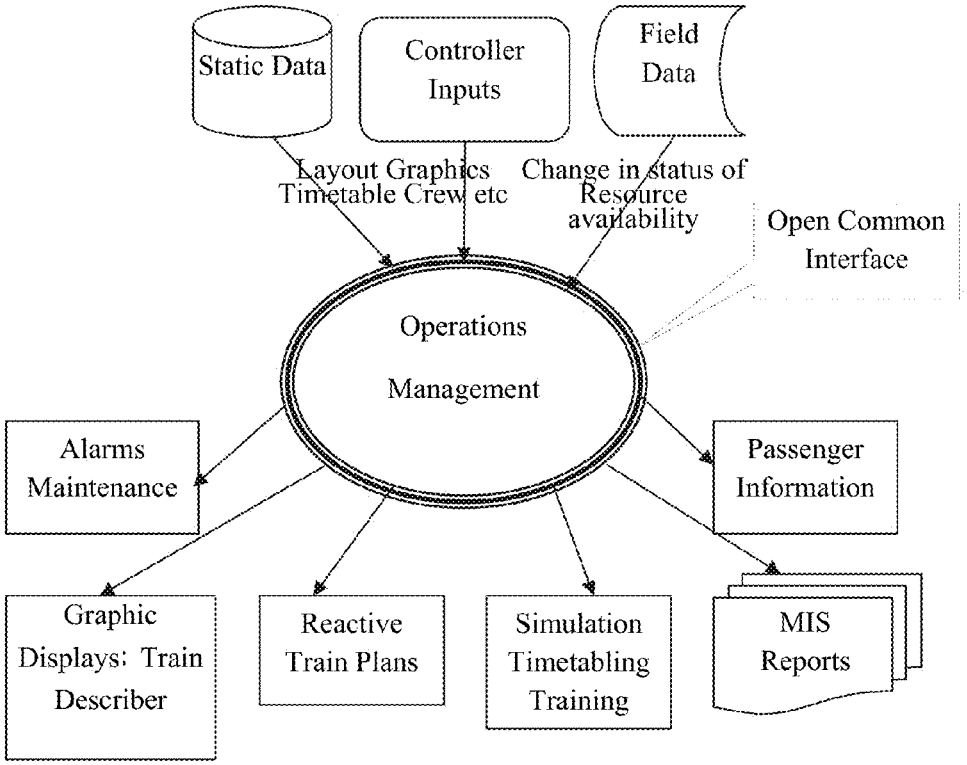
FIG. 2 illustrates an information management processes in an exemplary embodiment of the disclosure.

Let us consider a railway network wherein the vehicle is a train. FIG. 2 illustrates the information management process. The system may be configured to provide operations management throughout the railway network by means of its first, second and the third processor. The system may receive input from mostly static data including dynamically changed data, controller inputs, field data and open common interface. The system may further process the input data and give output in the form of simulation, planning, training, alarms maintenance, passenger information, MIS reports and graphic displays.

Functionalities of the train modeling system may include:

1. Database Management (By Means of the First Processor)

A database of mostly static but also including dynamically changed descriptions of vehicles, other railway resources, timetable, and dynamic events may be maintained in the system. This data may be then made available to client systems for monitoring, planning, actual and plan display and reporting.

2. Train Scheduler & Planner (By Means of the Second Processor)

A train scheduler/planner (second processor) that allocates track and power resources to enable the voyages of the trains in the network using a computational means configured to minimize deviations of scheduled trains from published timetables or maximize the throughput of non-timetabled vehicles ensuring the absence of conflicts in the use of resources during the voyages and being compliant to other constraints of the movement of the trains, given their own nature and configurations as well as the nature of resources like tracks and power that they consume on their journey.

Referring to FIG. 1*a*, in the first processor (102) and optionally in the third processor (110) system (100) may have knowledge of operating policies, train characteristics, sectional times for particular types of trains, the railway network, among other static and dynamic data and information. The system may construct conflict-free the train paths for all trains in the system.

This scheduler planner may have two modes of operation:

On line mode: reads in events from the railway network as they occur and schedules or reschedules trains and other track vehicles in the system already running or expected to run within a pre-specified time horizon. This mode may be used by train dispatchers and controllers to operationally manage trains.

Off line mode: reads in changes in track or power resource descriptions and some stored historical events from the railway network to schedule or reschedule trains and/or other track vehicles within a pre-specified time horizon. This mode may be used by train timetablers, maintenance controllers and infrastructure planners. Schedule planning tools may be provided to allow a Planner/Controller to create and modify traffic plans or to analyze past operations.

a. Conflict-Free Schedules and Plans (By Means of Second Processor)

A feature of the scheduler/planner algorithm (embedded in the second processor (112)) may be the conflict free nature of the train schedule or plan provided. The algorithm may ensure availability of resources, unary or discrete, thereby eliminating any probability of a conflict or clash of resource occupation between two or more vehicles/trains. This may ensure that the plans are implementable without change.

In a degraded fall back option, manual detection and resolution of conflicts is also possible. Correction of these conflicts may be achieved by manipulation of the train schedules to alter the times at the passing loops.

b. Special Trains and Occupations

One embodiment of the first processor (102) of the system (100) may incorporate the following, but not limited to, facilities to capture vehicle and resource descriptions and constraints for use by the second processor (104), while preparing on-line schedules, or timetables and advance operations for off line use, or for planning speed restrictions and other maintenance.

Advance information on external or special trains operating in the geography is of assistance to train Planners/Controllers for planning and management purposes.

Similar information for occupations such as required by ballast trains, track work or bridge works which may affect train operations and temporary speed restrictions is also desirable to be available early.

The system (100) may permit the capture and use of advance information about special trains and occupations. Special trains include but are not limited to accident relief vans and occupations indicate the presence of an irregular or abnormal vehicle on the track. Advance information on these special trains and abnormal operations may be fed to the second processor (104) to enable the rescheduling of the normal vehicles in an optimal manner.

3. Interactive Graphical User Interface (By Means of the Third Processor)

The Graphical User Interface may aid the Planners/Controllers to:

Monitor the movement of the trains and other vehicles in the system together with the status of the signals, points, etc.

Issue commands to create special events to manage changes to planned activity.

Windows based man machine interfaces may link Planner/Controller interfaces or workstations in the central control with the control, passenger information and to each other. Both the mouse and the keyboard may be used to initiate Planner/Controller functions while the keyboard may be used for alphanumeric input when required.

The system may have an option for using multilingual displays including a regional language. The main display on the screens may consist of the graphical representations of train movement and/or control—Train Graph and Detail Command buttons may be normally positioned both at the top and the bottom of the screen.

At positions with multiple screens, each screen may be useable for all functions. Where more than one monitor is used, all monitors may be capable of displaying any of the control displays. It may be also possible to display independent copies of any control display on each of the monitors. A user may be able to invoke any relevant or displayed function on any monitor, and a function invoked on a monitor may display any windows relevant to that function on that monitor.

When an event is received the representation underlying a displayed object changes and the object may redraw. The displays may refresh in response to field and Planner/Controller initiated events, including:

train/vehicle movements between track sections and/or arrival at or dispatch from stations train schedules being created, modified or deleted maintenance blocks being proposed, modified or cancelled.

a. Train Graph Display

The Train Graph display may be used to monitor/view/collect:

train positions with actual history and extrapolations for the planned future train schedules (both timetabled and with changes made by the Planners/Controllers)

operational Alarms and their status maintenance and other blocks on resources, e.g. at stations/sections the Planners/Controllers' notes on unplanned activities and events The display may have station mnemonics and distances on the vertical axis and time on the horizontal axis on a background grid. The current time may be displayed as a vertical line drawn between the horizontal axis at the current time, with a background colour change across the divider. The body of the graph may use line colour, thickness/style to depict trains of different types on different tracks. All graphs may be labelled with a train number. Other information accessible may include:

Train/rake numbers, types and schedules (timetabled/actual)

Resource/track/power section occupations, routes/authorities maintenance blocks

Alarms and their status

Planner/Controller notes

Planners/Controllers may control the displayed graph by panning in the horizontal and vertical axes by selecting filter on type(s) of train/track to display or toggling on/off display of timetables of trains.

Some of the objects the Planner/Controller may select for more detailed information include:

trains maintenance blocks resources/stations/sections

Planner/Controller notes

System functions may be accessed using coded buttons and pull-down menus. These may include:

inspect, create, delete or modify a train (schedule)

copy a train (template) as a new train plot the displayed graph on a plotter select other displays or user functions It may be possible to graphically directly edit/select various on-screen representations of the schedule while entering or modifying a train's schedule.

The train graph display may act as the user interface to: indicate the desired origin and destination of the train path by mouse or keyboard operations; select a standard pattern for a train from a list of pre-defined stopping patterns; select the train type from a pre-defined list; adjust the departure time, arrival time or some midpoint time; indicate which path is to be followed when there are multiple paths that could be traversed in order to reach a destination; cancel trains.

b. Detail Display

The detail display may make it convenient to visualize specific recorded static but also including dynamically changed details of resources like passing loops, stations and/or block sections. By focusing on selected portions of the railway network, this view may permit the Planner/Controller to comprehend resource e.g. station/passing loop or section usage/occupancy. Tracks, vehicles and signaling, etc. may be schematically laid out to support convenient recognition by the operator.

4. System Functions

System functions may be invoked using the buttons in the commands region. A button may either invoke a function directly or will display a pull-down menu of functions or further pull-down menus that can be invoked. This may allow common commands to be invoked easily and related commands to be grouped together. Function requiring further Planner/Controller inputs may display one or more appropriate windows to permit such inputs.

5. Alarms, Special Event Management

Messages describing special events requiring Planner/Controller response may generate an alarm comprising a visible and audible indication. Alarms may be generated by either:

indications from field devices and train operations computing, communications or data capture faults Alarms may need to be attended to with varying levels of priority and this is distinguished to the operator using a differential color coding strategy.

Alarms may reside in different states. Unacknowledged alarms are normally represented by a flashing indication that would become steady when acknowledged. New alarms may be accompanied by an audible tone.

Alarms may be associated with a variety of possible configurable actions. This selection may be made using the source or function of the alarm message. Appropriate assistance may be provided for responding, for example to forward the alarm to the maintenance operator.

Acknowledging or responding to an alarm may cause a change in status event. The alarm may be removed from the display when the action relevant to the alarm is completed.

Alarms may be displayed in a fixed area of the train graph screen that is easily noticeable. Alarms may occupy fixed-size slots, one slot per indication, grouped by priority, ordered by the recent trigger. Repeat alarms from the same source may not be separately displayed. The alarms region may not be overwritten or obscured by any other displays or windows.

6. Administration

Administration may include, but is not limited to: logging on and off the system; administering the system; and reporting system performance and reporting system status.

a. Logging On and Off the System

Before using the system, all users may be required to enter their user name and a password. The name may have an access level associated with it which will control the system functions the user is able to perform. The name may uniquely identify the user and may not be required to be kept secret.

b. Administering the System

Administering the system may include but is not limited to the following functions: monitoring of data communications paths; monitoring of field devices; monitoring of control system hardware; control of user logon name and password; management of Planner/Controller notes; facilities to change the data bases; and reporting system performance and reporting system status.

The system may provide facilities for the recording and reporting of train performance, activities which cause variances in operations, and maintenance activities associated with track work forces.

The reports may include: summaries of on time running; summaries of vehicles run but not timetabled; consolidated Planner/Controller notes; and activity event logs. The system will print these reports in response to an operator request, or at times specified by a system manager.

7. Hardcopy Outputs and Reports

Hardcopy output may be available as printed reports and plots of train graphs. This information may be suitable for historical reference as well as a method of performing train control by voice orders in the event of catastrophic failures.

8. Event Logging and Playback, Simulation

The control system may log the inputs received from other systems, and the outputs generated by the control system in response to these inputs. The current log file may retain events for at least the last 14 days before being archived. Facility for archiving these logs and the contents of the databases as at the time the event logs were started (not at the time they were archived) may be available.

Given a set of archived databases and event logs, it may be possible for the events to be played back, with the system taking its input from the event logs and regenerating responses to these inputs.

The database content as at the time of starting the event logs may be required to enable the system to be restarted in the state it was at that time.

In playback mode, the system may be redisplay all workstation output, display any text entered by the Planner/Controller, highlights any command buttons selected by the Planner/Controller, but will only log outputs to other systems. This is so that it can be seen what the Planner/Controller and the workstation did without affecting the operational system.

Figure 3:
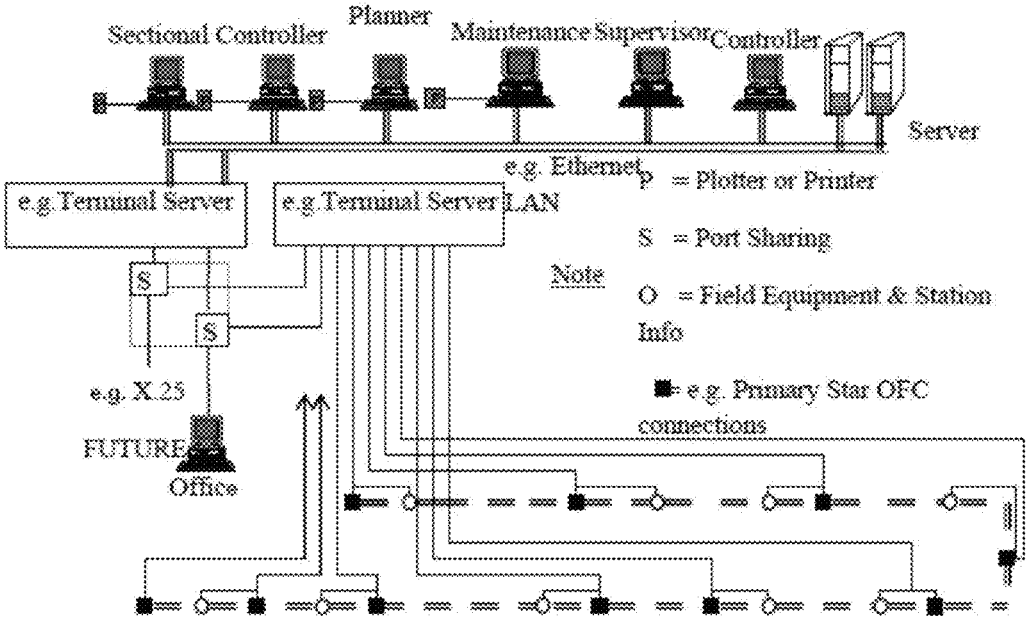
FIG. 3 illustrates typical control room layout & connection to field describing the hardware used in a vehicle movement modeling system in an exemplary embodiment of the disclosure.

FIG. 3 illustrates a typical control room layout and its connection to the field. The hardware for the control center may only use commercially available equipment. Normally a minimum of three workstations may be used at each control site being for two planners/controllers and maintenance that communicates to server. The maintenance workstation, in addition to monitoring the performance of the entire signalling system including the workstations and communications network (Ethernet LAN), may also be capable of being used as a planner/controller position backup. The functions available may be controlled by password entry. Moreover, it may be possible to add additional workstations at any time.

The nature and configurations of the hardware and communications components and user roles as depicted are merely indicative. The above disclosed exemplary techniques may provide a system and method for vehicle movement modeling in a network of railways. They may provide a system and method for adaptive rescheduling of the vehicle movement in railway networks. They may provide a system and method to ensure the absence of conflicts in vehicle movements in railway networks provide a system and method to generate graphs and visual layouts of vehicle movements over the railway networks.

The foregoing description of specific embodiments of the present disclosure has been presented for purposes of illustration and description. They are not intended to be exhaustive or to limit the disclosure to the precise forms disclosed, and obviously many modifications and variations are possible in light of the above teaching. The embodiments were chosen and described in order to best explain the principles of the disclosure and its practical application, to thereby enable others skilled in the art to best utilize the disclosure and various embodiments with various modifications as are suited to the particular use contemplated. It is intended that the scope of the disclosure be defined by the claims appended hereto and their equivalents. The listing of steps within method claims do not imply any particular order to performing the steps, unless explicitly stated in the claim.

What is claimed is:

1. A method for vehicle movement modeling in a railway network based on vehicle related intelligence gathering, processing and dissemination thereof for an adaptive rescheduling of the vehicle movement in the railway network, the method comprising:

acquiring, predefined data related to a type, a position, a movement and a schedule associated with vehicles in railway networks with respect to changes at regular intervals;

processing the predefined data to ensure an absence of resource usage conflicts in the railway networks, the processing further comprising:

allocating one or more resources for one or more voyages of one or more vehicles, developing plans for the voyages, wherein the plans are intended to minimize deviations of scheduled vehicles from published timetables and maximize a throughput of non-timetabled vehicles; and computing one or more occupations, wherein the occupations include consideration of inter-vehicle safety gap over and above the headway clearance by a previous vehicle and inter-vehicle start gap to accommodate power consumption, wherein the power consumption includes surges when the vehicle accelerates; and generating one or more visual depictions of the plans in form of train graphs and detailed layouts of past, present and future vehicular movements on a plurality of sections of the railway networks, over a defined time horizon.

2. The method of claim 1, wherein the vehicle is a train, and wherein the train is electrically-powered.

3. The method of claim 1, wherein the predefined data comprises data related to at least one of trains, train schedules, details of stations, and geometry of tracks.

4. The method of claim 1, wherein the plan for the voyages comprise at least one of plan for the voyages that schedule conflict-free meeting, passing and crossing of the vehicles over interrelated voyages of the vehicles, and plans for the voyages generated at least as rapidly as the occurrences of events within the railway network.

5. The method of claim 1, wherein the one or more types of resources comprise unary resources and discrete resources, wherein the unary resources include block sections and loops, and the discrete resources include electric traction power resources.

6. The method of claim 5, wherein occupancy planning of the block sections further comprises arranging the vehicles in groups according to priorities of the vehicles, wherein the priorities of the vehicles can be dynamically changed while a train movement is being planned.

7. The method of claim 6, wherein an action is further deduced by picking up the vehicles for voyage planning in a decreasing order of the priorities of the vehicles.

8. The method of claim 1, wherein the conflicts comprise meeting and crossing of the vehicles having equal priorities, or unequal priorities.

9. The method of claim 1, wherein revised plans are illustrated using one or more time-distance train graphs and other detail graphics capable of providing zoomed view of track details and allocation of the resources.

10. The method of claim 1, further comprising storing historical information about data objects in proper time in order to process the data objects in an offline mode including a simulator mode.

11. The method of claim 10, wherein the offline mode assists in developing time tables, routes, infrastructure maintenance blocks, and evaluating options for infrastructure investments including tracks, signaling and operating practices.

12. The method of claim 1, further comprising inferring the track occupation display graphics, power territory occupations display graphics and the resources for scheduling from a common set of description files.

13. A system for vehicle movement modeling in a railway network based on vehicle related intelligence gathering, processing and dissemination thereof for an adaptive rescheduling of the vehicle movement in the railway network, the system comprising:

a first processor configured to acquire, a predefined data for a type, a position, a movement and a schedule associated with vehicles in railway networks with respect to changes at regular intervals;

a second processor configured to process the predefined data so acquired to generate a conflict-free vehicle movement plan in a railway network, the second processor is further configured to:

allocate one or more resources for one or more voyages of one or more vehicles;

develop plans for the voyages, wherein the plans minimize deviations of scheduled vehicles from published timetables and maximize a throughput of non-timetabled vehicles ensuring an absence of conflicts in use of the resources during the voyages; and compute one or more occupations, wherein the occupations include consideration of inter-vehicle safety gap over and above the headway clearance by a previous vehicle and inter-vehicle start gap to accommodate power consumption, wherein the power consumption includes surges when the vehicle accelerates; and a third processor configured to generate one or more visual depictions of the plans in form of train graphs and detailed layouts of past, present and future vehicular movements on a plurality of sections of the railway networks over a defined time horizon.

14. The system of claim 13, wherein the vehicle is a train, and wherein the train is electrically-powered.

15. The system of claim 13, wherein the predefined data comprises at least one of data related to trains, train schedules, details of stations, and geometry of tracks.

16. The system of claim 13, wherein the plan for the voyages comprise at least one of plan for the voyages that schedule conflict-free meeting, passing and crossing of the vehicles over interrelated voyages of the vehicles, and plans for the voyages generated at least as rapidly as the occurrences of events within the railway network.

17. The system of claim 13, wherein the one or more types of resources comprise unary resources and discrete resources, wherein the unary resources comprise block sections and loops, and the discrete resources comprise electric traction power resources.

18. The system of claim 17, wherein occupancy planning of the block sections further comprises arranging the vehicles in groups according to priorities of the vehicles, wherein the priorities of the vehicles can be dynamically changed while a train movement is being planned.

19. The system of claim 18, wherein an action is further deduced by picking up the vehicles for voyage planning in a decreasing order of the priorities of the vehicles.

20. The system of claim 13, wherein the conflicts comprise meeting and crossing of vehicles of equal priorities, or of unequal priorities.

21. The system of claim 13, wherein revised plans are illustrated using one or more time-distance graphs and other detail graphics capable of providing zoomed view of track details and allocation of the resources.

22. The system of claim 13, wherein the system is further configured to store historical information about data objects in proper time in order to process the data objects in an offline mode including a simulator mode.

23. The system of claim 13, further comprising an ensemble of a multiplicity of internal networking, communicating and cooperating systems to cover a multiplicity of networked railway sections.

24. The system of claim 13, wherein the third processor further infers the track occupation display graphics, power territory occupations display graphics and the resources for scheduling from a common set of description files.

25. The system of claim 13, further comprising one or more sub-systems with a plurality of railway networks, wherein the plurality of railway networks comprises multiple signaling and traction power information systems.

* * * * *